US006520518B2

(12) United States Patent
Lo

(10) Patent No.: US 6,520,518 B2
(45) Date of Patent: Feb. 18, 2003

(54) ALUMINUM SKATEBOARD

(76) Inventor: Albert Chong-Jen Lo, 3023 Windy Knoll Ct., Rockville, MD (US) 20850

( * ) Notice: Subject to any disclaimer, the term of this patent is extended or adjusted under 35 U.S.C. 154(b) by 0 days.

(21) Appl. No.: 09/863,334

(22) Filed: May 24, 2001

(65) Prior Publication Data

US 2002/0175484 A1 Nov. 28, 2002

(51) Int. Cl.[7] ..... B62M 1/00
(52) U.S. Cl. ..... 280/87.41; 280/87.42
(58) Field of Search ..... 280/87.41, 87.42, 280/842, 609, 610, 14.21, 602; 441/68, 74

(56) References Cited

U.S. PATENT DOCUMENTS 1,552,990 A * 9/1925 Hunt ..... 441/68
4,135,732 A * 1/1979 Magnus ..... 280/610
4,337,963 A * 7/1982 Stevenson ..... 280/610
4,634,140 A * 1/1987 Stroi ..... 280/610
5,267,743 A * 12/1993 Smisek ..... 280/87.042
5,299,822 A * 4/1994 Mayr et al. ..... 280/610
5,554,816 A * 9/1996 Skaggs et al. ..... 89/36.17
6,203,037 B1 * 3/2001 Wilson et al. ..... 280/87.042
6,293,571 B1 * 9/2001 Wen ..... 280/87.042

* cited by examiner

*Primary Examiner*—Brian L. Johnson
*Assistant Examiner*—Hau Phan
(74) *Attorney, Agent, or Firm*—Bacon & Thomas, PLLC

(57) ABSTRACT

An aluminum skateboard. The skateboard is made of aluminum and includes an upper plate and a lower plate. Both sides of the plates are closely connected together to form an inner hollow compartment. Reinforcing ribs are integrally formed on the inner wall of each plate. The ribs of respective plates oppose each other and a buffer gap is formed between every two corresponding reinforce ribs of the respective plates. The aluminum skateboard increases overall elasticity in order to increase shock absorbing qualities and to minimize injuries to the user.

2 Claims, 4 Drawing Sheets

ALUMINUM SKATEBOARD

BACKGROUND OF THE INVENTION

This invention relates to an aluminum skateboard made of aluminum integrally squeezed in shape, having an upper plate and a lower plate, with two sides of the upper and the lower plates closely connected together, forming an inner hollow compartment, and plural reinforce ribs integrally formed spaced apart on the inner wall of each plate and positioned upward and downward and facing each other, forming a buffer space between every two corresponding reinforce ribs. The aluminum skateboard of such design is capable to increase buffer elasticity as well as to elevate the effect of shock absorbing and has the same function as an air cushion to prevent a user from injured.

A conventional aluminum skateboard is a plate body made of aluminum first squeezed into shape, with two sides closed up forming a hollow interior and then cut and processed, and having plural reinforce ribs formed integral on the inner wall of the upper and the lower plate in order to reinforce the whole aluminum skateboard and prevent an intermediate portion of insufficient strength from disfiguring by stamping.

However, the reinforcing ribs formed integral on the inner walls of the upper and the lower plates always weaken the elasticity of the plate body so an accident of physical exercise injury is liable to happen. The reason why the conventional skateboard is possible to result in physical exercise injury is described below.

Rough ground surfaces and depressions on roads are certain to make the skateboard sliding on it rocking and vibrating, and some users like to make fancy actions such as jumping or the like on the skateboard so that the skateboard must have proper elasticity, but, the reinforce ribs formed integral on the inner walls of the upper and the lower plates have no effect of buffer so, when the skateboard passes on depressions on a road or the user makes actions of jumping or the like, the vibration produced will directly transmit from the skateboard to a user's ankle joint and absorbed by his/her body. It is certain that a slight vibration caused by gentle movement of the skateboard on a road is unlikely to harm human skeleton, but, if the user carries on double difficult actions such as jumping, turning over or the like on the skateboard, the bumping force caused by dropping down on ground will directly transmit to human body, thus giving rise to physical exercise injuries because the bumping force is too great to be borne by human body and the skateboard has not enough buffer effect.

SUMMARY OF THE INVENTION

The objective of the invention is to offer an aluminum skateboard having effect of shock absorbing as well as a function of an air cushion and possible to enhance the buffer elasticity of an aluminum skateboard and prevent physical injuries caused by exercise.

The feature of the invention is plural reinforce ribs formed integral on the inner walls of the upper plate and the lower plate, positioned upward and downward and facing each other and forming a buffer gap between every two corresponding reinforcing ribs.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
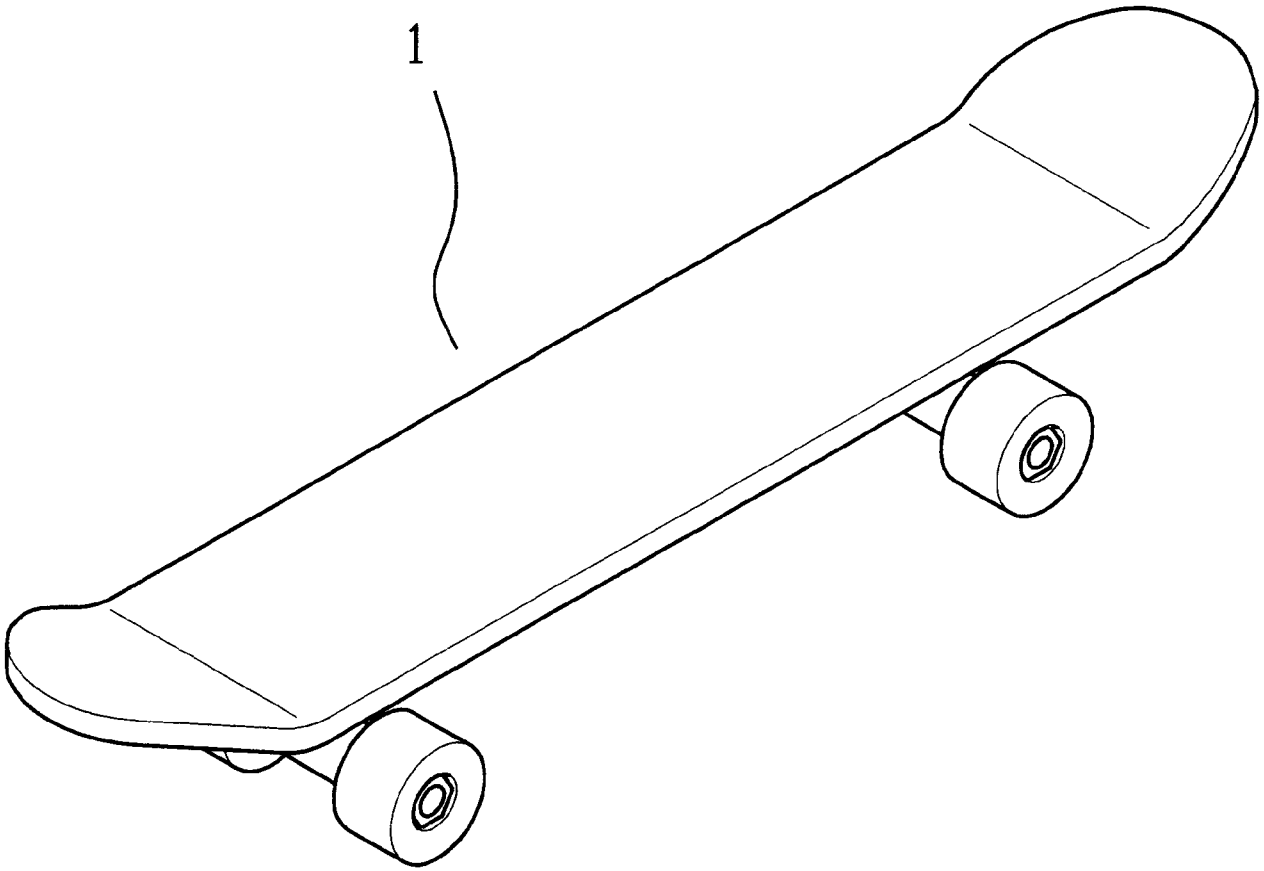
FIG. 1 is a perspective view of an aluminum skateboard in the present invention.
Figure 2:
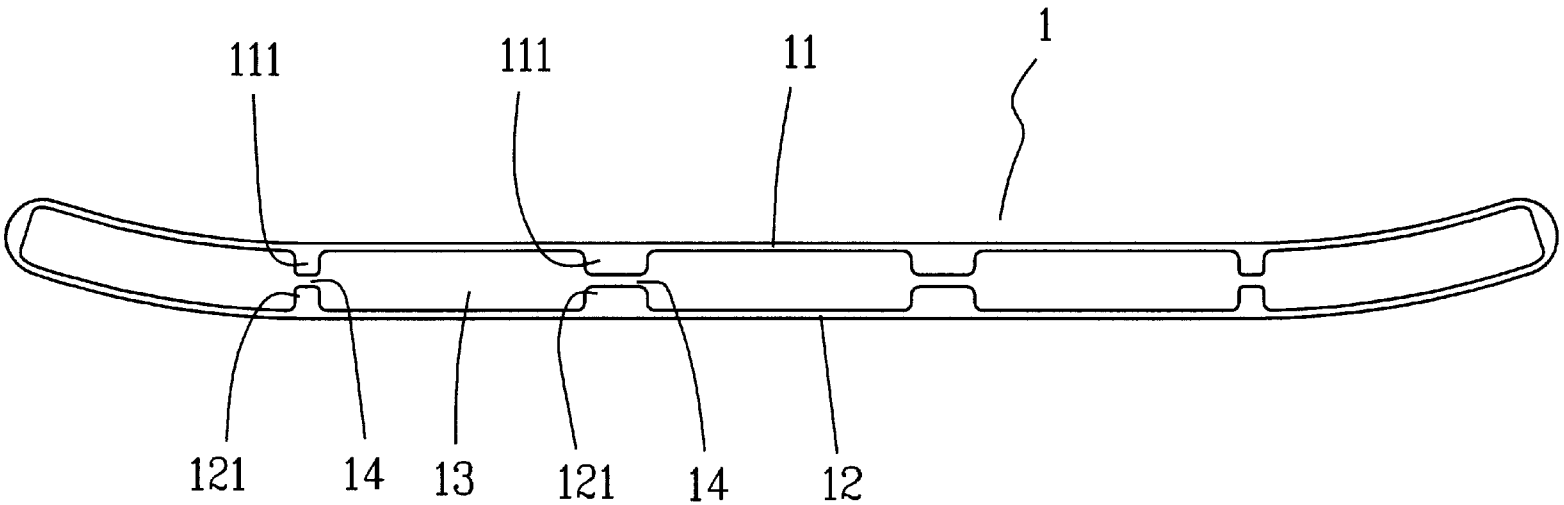
FIG. 2 is a cross-sectional view of a first embodiment of the aluminum skateboard in the present invention.

Referring to FIGS. 1 and 2, a preferred embodiment of an aluminum skateboard 1 in this invention is made of aluminum squeezed integral in shape and has an upper plate 11 and a lower plate 12, and both sides of two plates 11,12 are closely combined together, forming an inner hollow compartment 13, and plural reinforce ribs 111, 121 are formed integral and spaced apart on the inner wall of each plate 11,12, protruding upward and downward and facing each other with a buffer gap 14 of a proper width formed between every two corresponding reinforcing ribs 111,121.

Figure 3:
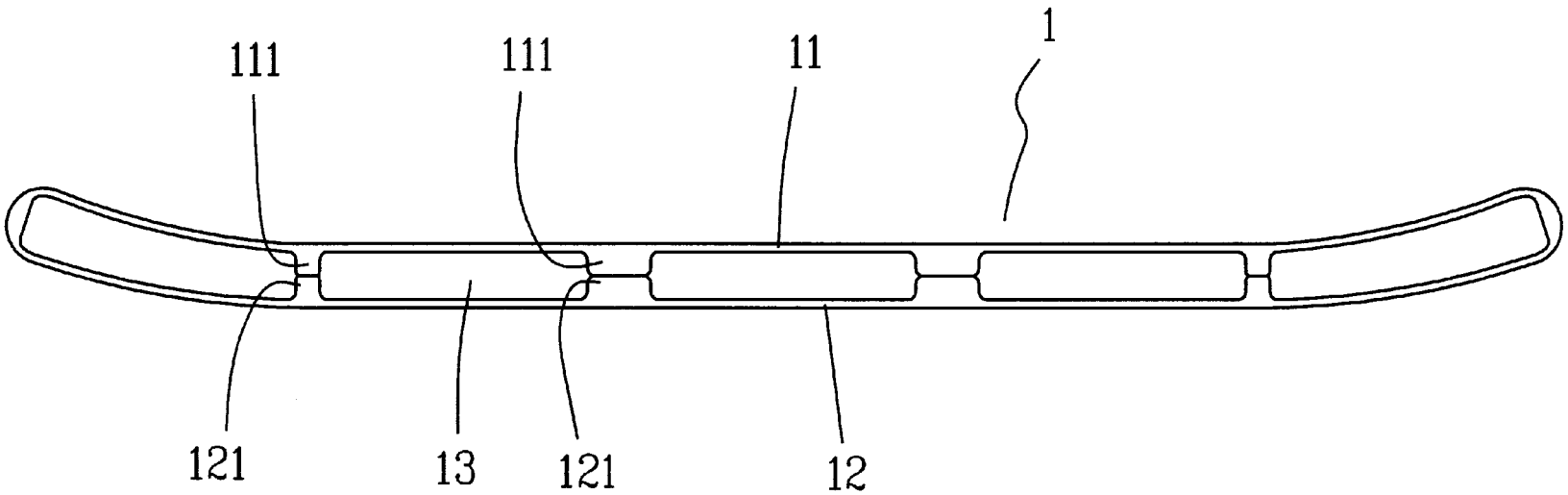
FIG. 3 is a cross-sectional view of the aluminum skateboard [in using condition] when the skateboard is compressed, in the present invention: and, FIG. 4 is a cross-sectional view of a second embodiment of the aluminum skateboard in the present invention.

Under such design, the closed air compartment 13 is formed inside two plates 11,12 and the buffer gap 14 is formed between two corresponding reinforcing ribs 111, 121 function as an air cushion. When the aluminum skateboard 1 is sliding on the ground, coming across depressions on road and giving rise to rocking and vibrating, this vibration will be directly absorbed by the skateboard 1 and by the air in the closed air compartment 13. Besides, when the aluminum skateboard 1 together with its user drop down to the ground from a high position, the great bumping force caused by acceleration of gravity will be absorbed by the upper and the lower plates 11,12 and by the air within the buffer gap 14, not completely transmitting to human body, possible to prevent injuries of physical exercise, Specifically, at the moment the aluminum skateboard 1 bumps against the ground, the air in the buffer gaps 14 between reinforcing ribs 111,121 together with the air in the closed air compartment 13 of the aluminum skateboard 1 will function to bring forth buffer elasticity. When the skateboard 1 keeps on being compressed, the corresponding reinforcing ribs 111,121 of each pair of the upper and the lower plates 11,12 will rest against each other, as shown in FIG. 3, to prevent the aluminum skateboard 1 from disfiguring by bumping.

Figure 4:
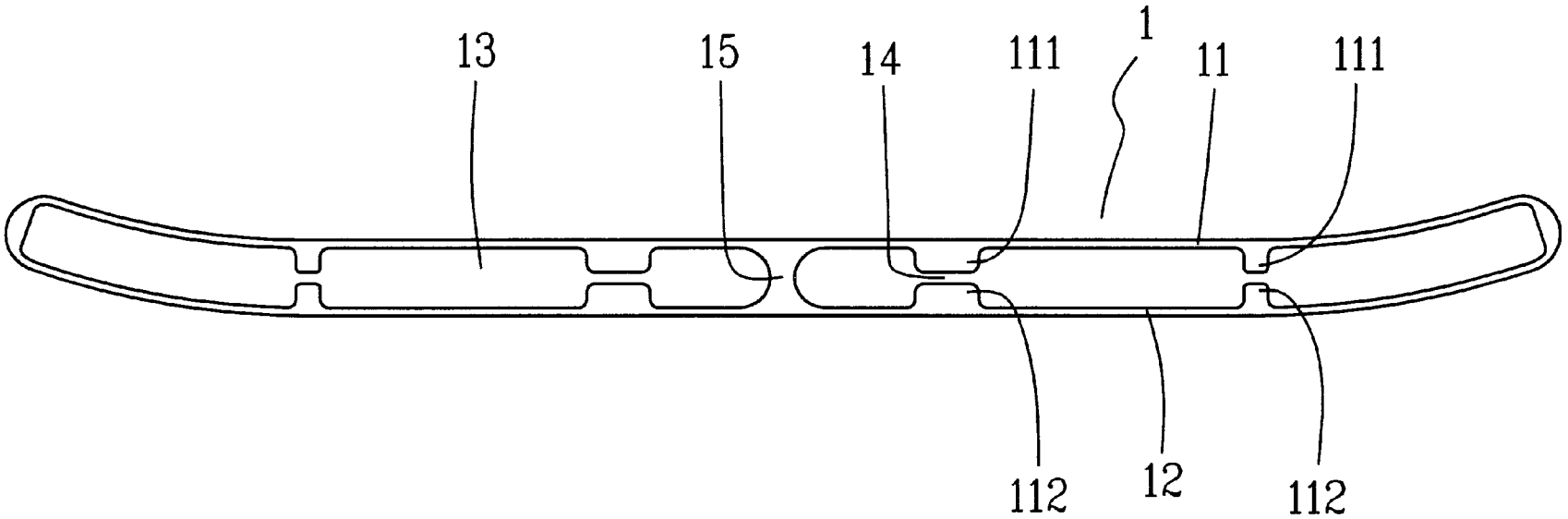

The embodiment described above is chiefly for children, and another embodiment of the aluminum skateboard 1 is designed for an adult. Aside from the original reinforcing ribs 111,121, a pillar-like reinforce rib 15 is additionally fixed in the hollow interior, with its top end and bottom end respectively connected with the inner walls of the upper and the lower plates 11,12, as shown in FIG. 4, thus increasing its support force.

To sum up, the aluminum skateboard in this invention is capable to increase the elasticity of the entire skateboard body, to enhance the effect of shock absorbing and to prevent any accident of exercise injuries.

While the preferred embodiments have been described above, it will be recognized and understood that various modifications may be made therein and the appended claims are intended to cover all such modifications that may fall within the spirit and scope of the invention.

I claim:

1. An aluminum skateboard device comprising:

an aluminum skateboard, said aluminum skateboard having an upper plate and a lower plate, both sides of said upper and said lower plates are closely connected together, forming a closed air compartment, and plural reinforcing ribs integrally formed on respective inner walls of each of said plates; and said reinforcing ribs on said inner walls of said plates are opposingly positioned upward and downward, facing each other and forming a buffer gap for providing an air cushion therebetween.

2. The aluminum skateboard device as claimed in claim 1, wherein a pillar-shaped reinforce rib is formed integrally in said closed compartment, with a top end and a bottom end of said pillar-shaped reinforce rib respectively connected with said inner wall of each of said plates.

* * * * *